US011234570B2

(12) United States Patent
Lee et al.

(10) Patent No.: US 11,234,570 B2
(45) Date of Patent: Feb. 1, 2022

(54) CLEANER

(71) Applicant: LG ELECTRONICS INC., Seoul (KR)

(72) Inventors: Seungjin Lee, Seoul (KR); Sangik Lee, Seoul (KR); Seaunglok Ham, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 353 days.

(21) Appl. No.: 16/369,060

(22) Filed: Mar. 29, 2019

(65) Prior Publication Data

US 2019/0298132 A1 Oct. 3, 2019

(30) Foreign Application Priority Data

Mar. 29, 2018 (KR) ..... 10-2018-0036563

(51) Int. Cl.
*A47L 9/28* (2006.01)
*A47L 9/16* (2006.01)

(52) U.S. Cl.
CPC ..... *A47L 9/28* (2013.01); *A47L 9/1683* (2013.01); *A47L 2201/04* (2013.01); *A47L 2201/06* (2013.01); *G05D 2201/0215* (2013.01)

(58) Field of Classification Search
CPC .. A47L 2201/04; A47L 2201/06; A47L 5/225; A47L 9/1683; A47L 9/28; A47L 9/2805; A47L 9/2852; A47L 9/009; A47L 9/1409; A47L 9/1691; A47L 9/2826; A47L 9/2836; A47L 9/2857; A47L 9/322; G05D 2201/0215
See application file for complete search history.

(56) References Cited

U.S. PATENT DOCUMENTS

| | | | | |
|---|---|---|---|---|
| 5,440,216 | A | 8/1995 | Kim | |
| 2017/0245702 | A1 | 8/2017 | Son et al. | |
| 2017/0245712 | A1* | 8/2017 | Son | A47L 9/00 |
| 2017/0245714 | A1* | 8/2017 | Son | A47L 9/0081 |
| 2017/0245719 | A1* | 8/2017 | Son | A47L 5/362 |
| 2017/0332855 | A1* | 11/2017 | Seo | A47L 9/1683 |
| 2018/0368645 | A1* | 12/2018 | Ham | G05D 1/0231 |

FOREIGN PATENT DOCUMENTS

| | | | | |
|---|---|---|---|---|
| CN | 108209748 | | 6/2018 | |
| JP | 6174294 | | 8/2017 | |
| JP | 6174294 | B2 * | 8/2017 | G08B 13/19 |
| KR | 20-1994-0004859 | | 7/1994 | |
| KR | 10-2003-0013008 | | 2/2003 | |

(Continued)

OTHER PUBLICATIONS

KR 100829094 B1—English Machine Translation (Year: 2008).*
International Search Report dated Jul. 24, 2019 issued in Application No. PCT/KR2019/003654.
Taiwanese Office Action dated Nov. 8, 2019 issued in TW Application No. 108110775.

(Continued)

*Primary Examiner* — Marc Carlson
(74) *Attorney, Agent, or Firm* — KED & Associates LLP

(57) ABSTRACT

A cleaner includes a cleaner body; a dust container which is accommodated in the cleaner body; a sensing module which detects information around the cleaner body and is mounted in the cleaner body rotatably about a rotating shaft that intersects a horizontal direction; and a driving module which rotates the sensing module in place relatively to the cleaner body.

20 Claims, 16 Drawing Sheets

(56) References Cited

FOREIGN PATENT DOCUMENTS

| | | | | |
|---|---|---|---|---|
| KR | 20030013008 | A | * | 2/2003 |
| KR | 10-0640752 | | | 11/2006 |
| KR | 100640752 | B1 | * | 11/2006 |
| KR | 10-0829094 | | | 5/2008 |
| KR | 100829094 | B1 | * | 5/2008 |
| KR | 10-0962123 | | | 6/2010 |
| KR | 100962123 | B1 | * | 6/2010 |
| KR | 10-2012-0098192 | | | 9/2012 |
| KR | 20120098192 | A | * | 9/2012 |
| KR | 10-2015-0127937 | | | 11/2015 |
| KR | 10-1710397 | | | 2/2017 |
| KR | 101710397 | B1 | * | 2/2017 |
| KR | 10-2017-0131164 | | | 11/2017 |
| KR | 10-2017-0131289 | | | 11/2017 |
| TW | 201731435 | | | 9/2017 |
| TW | 1610650 | | | 1/2018 |

OTHER PUBLICATIONS

Taiwanese Office Action (with English translation) dated Dec. 17, 2019 issued in TW Application No. 108108704.

U.S. Office Action dated Mar. 17, 2021 issued in U.S. Appl. No. 16/352,978.

Korean Notice of Allowance dated Nov. 25, 2019 issued in KR Application No. 10-2018-0029783.

U.S. Appl. No. 16/352,978, filed Mar. 14, 2019.

Australian Office Action dated Jul. 14, 2021 issued in AU Application No. 2019243374.

* cited by examiner

CLEANER

CROSS-REFERENCE TO RELATED APPLICATION

This application claims priority under 35 U.S.C. § 119 to Korean Application No. 10-2018-0036563 filed on Mar. 29, 2018, whose entire disclosure is hereby incorporated by reference. This application is related to U.S. application Ser. No. 16/352,978 filed Mar. 14, 2019, whose entire disclosure is also incorporated by reference.

BACKGROUND

1. Field

The present invention relates to a cleaner, and more particularly, to a cleaner having a rotatable sensing module.

2. Background

Generally, a cleaner includes a cleaner body having a suction unit and a dust container, and a cleaning nozzle which is coupled to the cleaner body and performs cleaning while being in close contact with a surface to be cleaned. The cleaner is divided into a manual cleaner for manually cleaning the surface to be cleaned by a user and an automatic cleaner for cleaning the surface to be cleaned while traveling by itself.

According to the manual cleaner, in a state where the suction unit generates a suction force by a driving force of an electric motor, when the user places the cleaning nozzle or the cleaner body on the surface to be cleaned while the user holds the cleaning nozzle or the cleaner body by hand, the cleaning nozzle sucks foreign matter including dust on the surface to be cleaned, and the sucked foreign matter is collected in the dust container, thereby cleaning the surface to be cleaned.

In addition, according to the automatic cleaner, the cleaner body having the suction unit and the dust container may be provided with various sensor units (ultrasonic sensor and/or camera sensor) to divide a traveling area, to recognize a surrounding environment, to avoid an obstacle, and to detect a cliff, or the like. The cleaning nozzle sucks the foreign matter on the surface to be cleaned by the suction force generated in the suction unit while the cleaner body automatically travels around the surface to be cleaned, and the sucked foreign matter is collected in the dust container, thereby cleaning the surface to be cleaned.

A sensor unit used in the automatic cleaner employs an optical system that irradiates light in one direction and detects reflected light or a system that emits sound waves in one direction and detects reflected sound waves. Such a sensor unit can only collect environmental information within a certain angle (angle of view) with respect to the sensing direction. According to the conventional automatic cleaner, the sensor unit is installed in front of the cleaner body and the sensor unit cannot rotate or move. Thus, there is a problem in that a detection range (angle of view) that the sensor unit can detect is very limited.

Korean Patent Laid-Open Publication No. 10-2017-0131289 discloses a cleaner having a sensor unit that is fixed to the front of a cleaner body. In the conventional automatic cleaner, since the sensor unit is fixed in the movement direction of the main body of the cleaner, there is a problem in that it is difficult to recognize an obstacle positioned in the lateral direction.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1A:
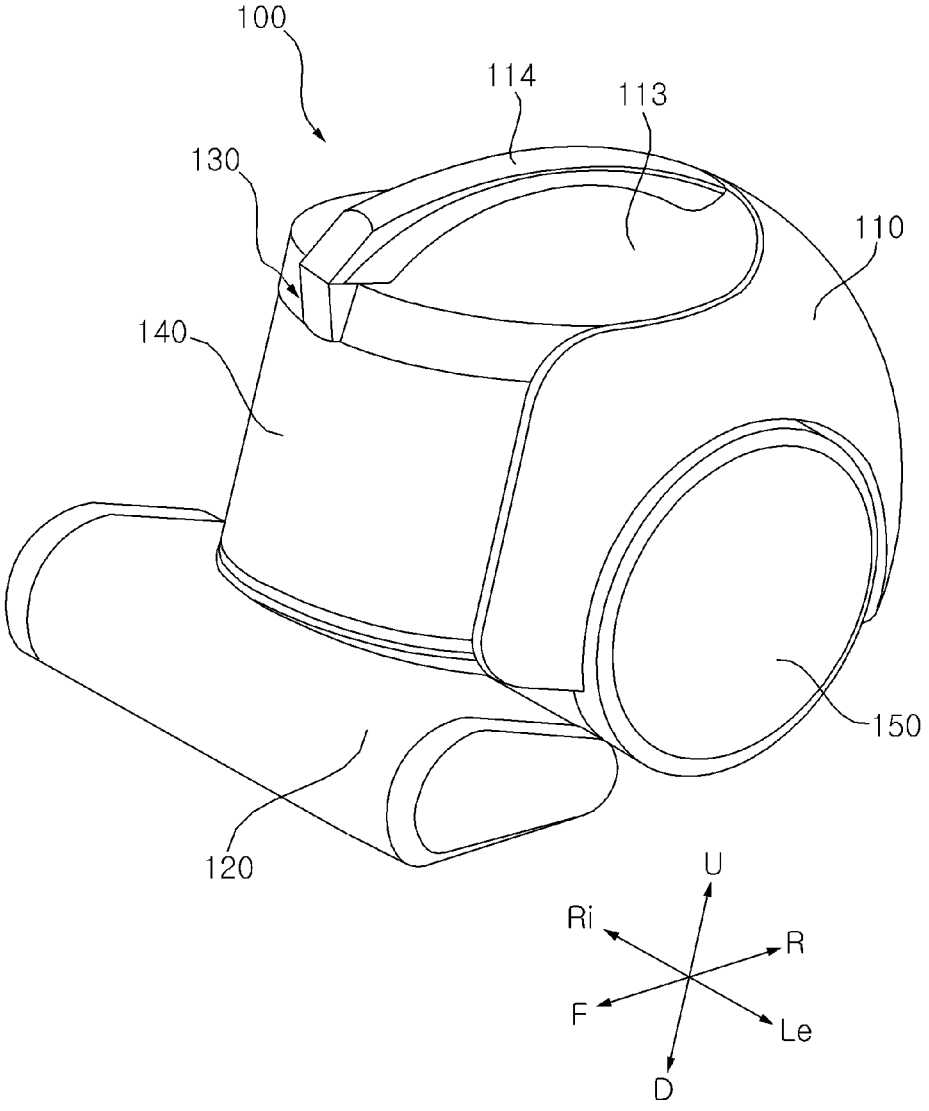
FIG. 1A is a perspective view illustrating a cleaner according to an embodiment of the present invention.

Hereinafter, preferred embodiments of the present invention will be described with reference to the accompanying drawings. In describing the present embodiment, the same designations and the same reference numerals are used for the same components, and further description thereof will be omitted. It will be understood that when an element (e.g., first element) is referred to as being "connected" or "coupled" to another element (e.g., second element), it can be directly connected or coupled to the other element (e.g., third element) or intervening elements may be present. The terminology used herein is for the purpose of describing particular example embodiments only and is not intended to be limiting of the present inventive concept. It should also be noted that in some alternative implementations, the functions/acts noted in the blocks may occur out of the order noted in the flowcharts.

Figure 1B:
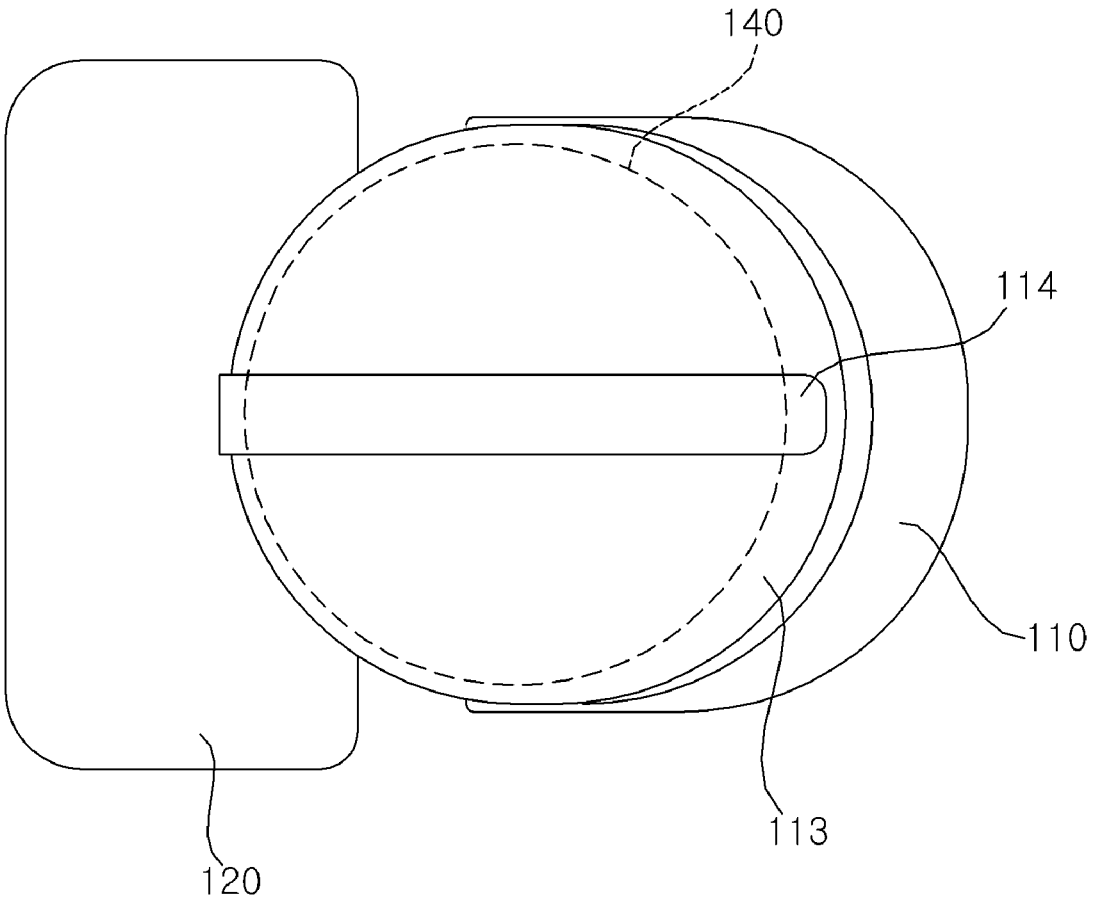
FIG. 1B is a schematic plan view of a cleaner according to an embodiment of the present invention.

Hereinafter, a cleaner according to an embodiment of the present invention will be described with reference to the drawings. FIG. 1A is a perspective view illustrating a cleaner according to an embodiment of the present invention, FIG. 1B is a schematic plan view of a cleaner according to an embodiment of the present invention, and FIG. 2 is a diagram illustrating a cleaner in a state in which a dust container is separated in FIG. 1A.

Figure 2:
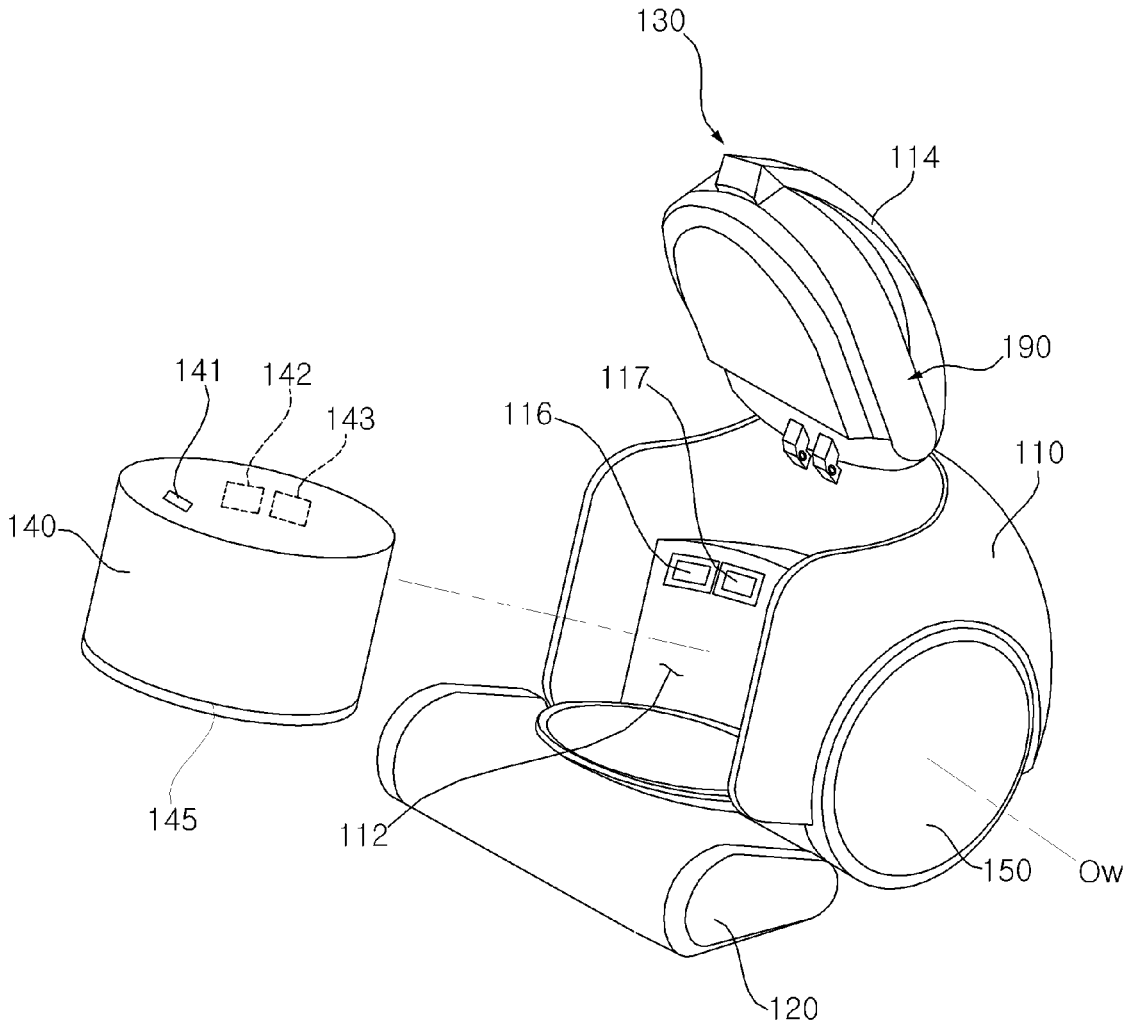
FIG. 2 is a diagram illustrating a cleaner in a state in which a dust container is separated in FIG. 1A.
Figure 3:
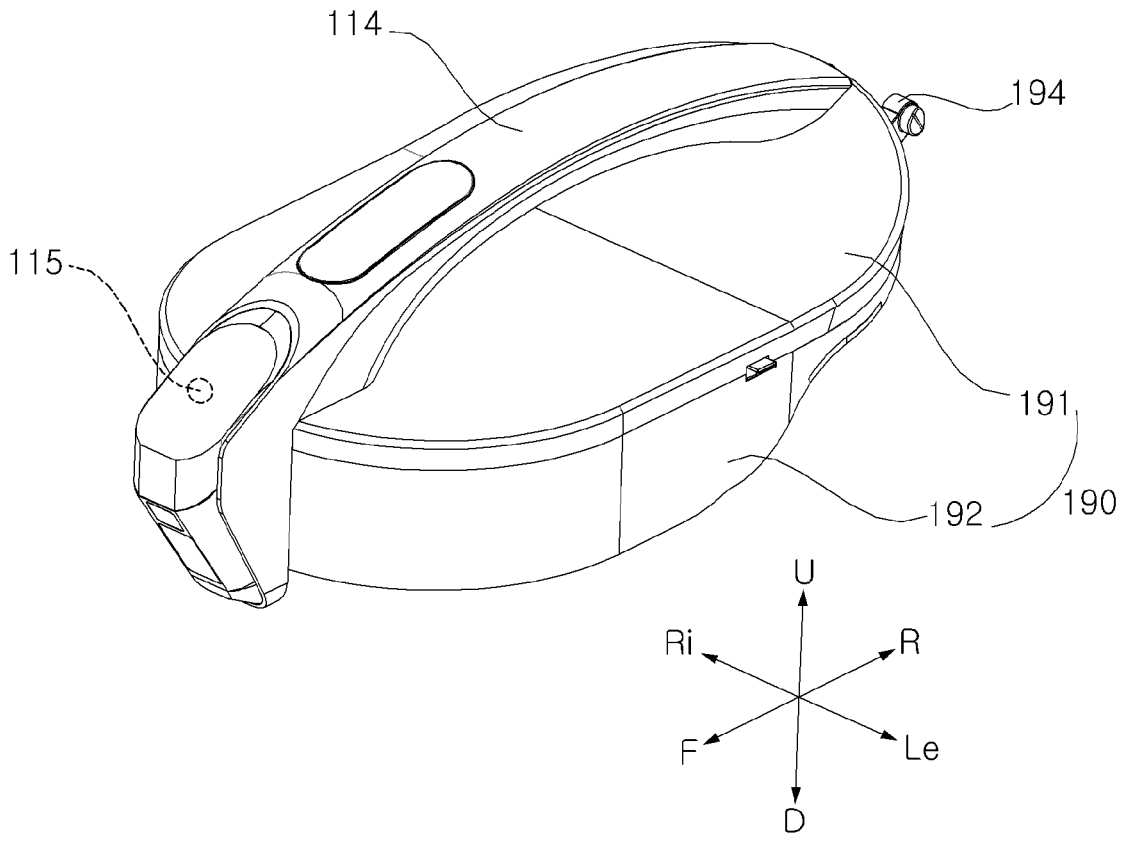
FIG. 3 is a perspective view of a dust container cover including a sensing module and a driving module according to an embodiment of the present invention.
Figure 4:
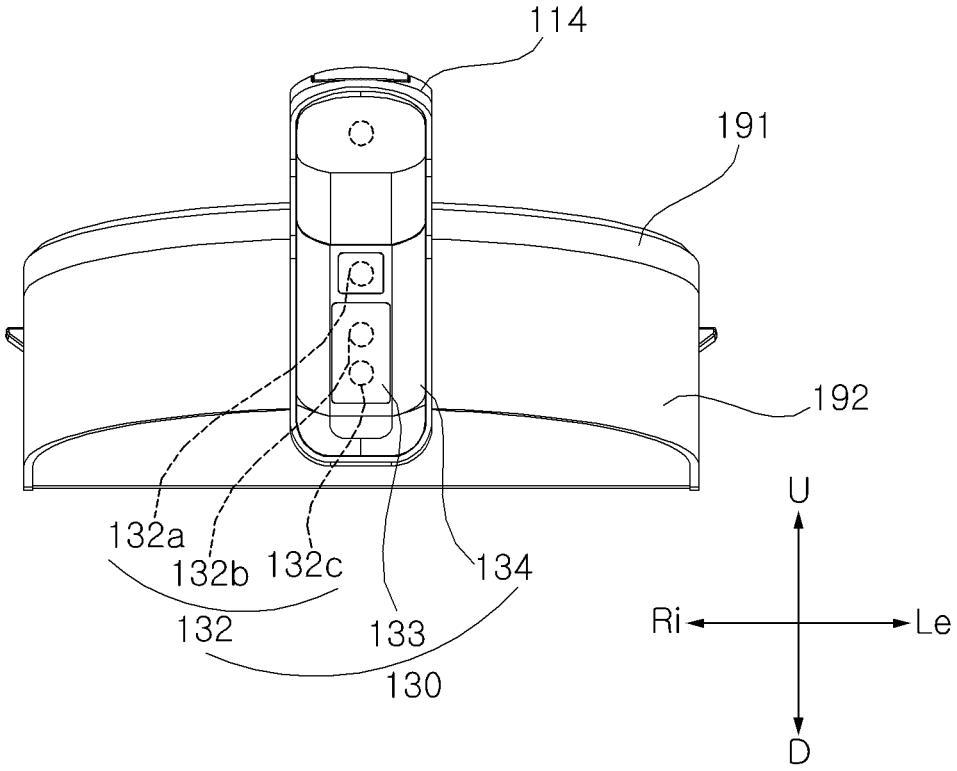
FIG. 4 is a front view of the dust container cover of FIG. 3.
Figure 5:
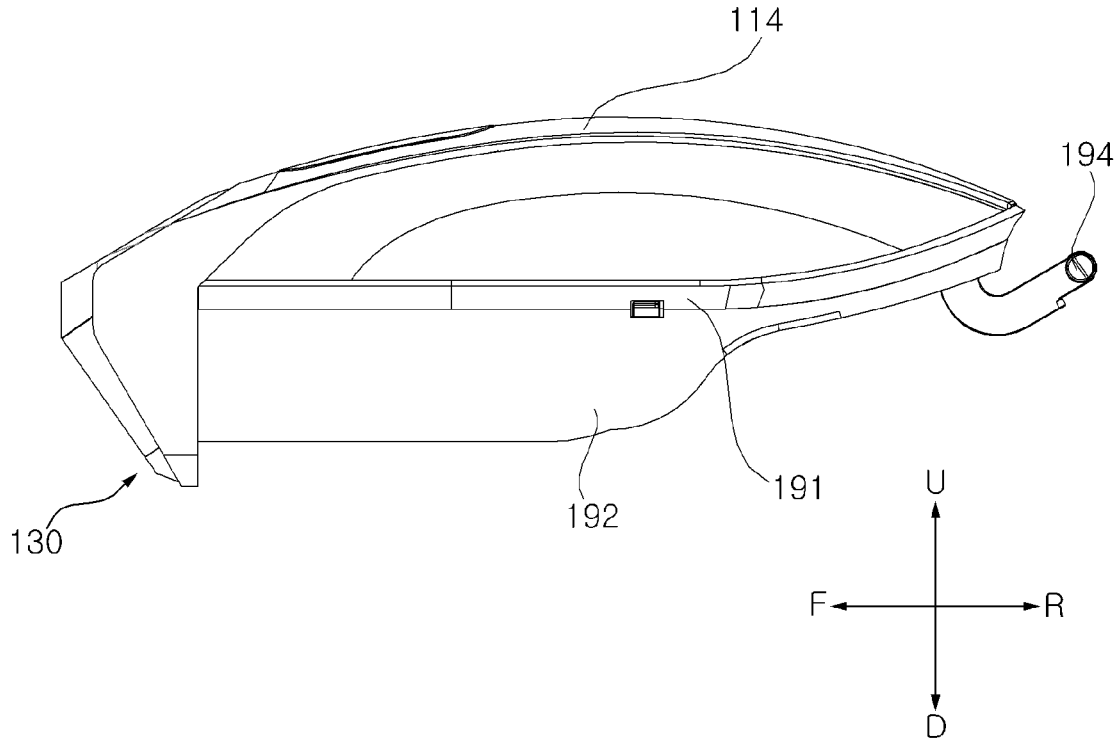
FIG. 5 is a side view of the dust container cover of FIG. 3.
Figure 6:
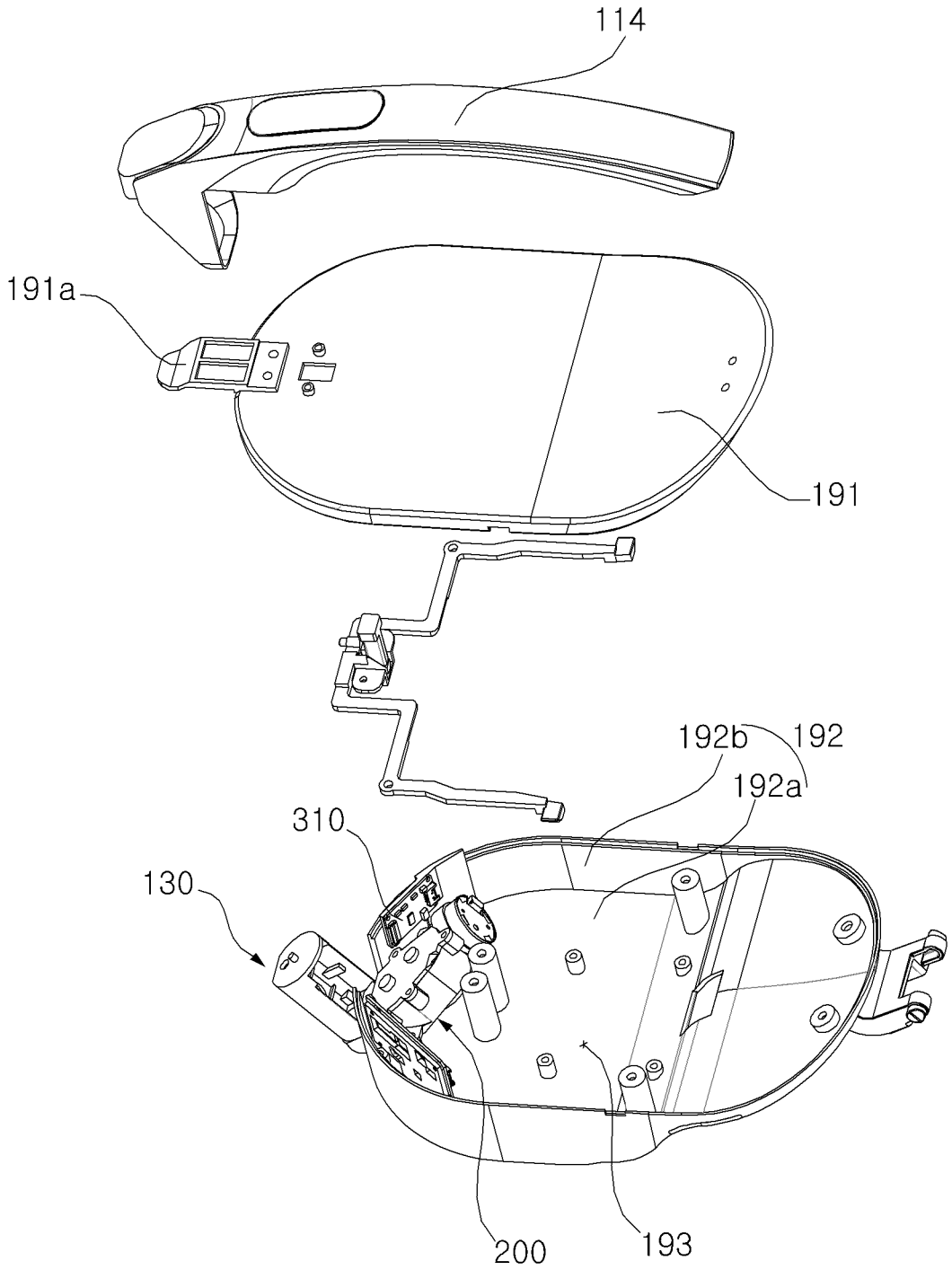
FIG. 6 is an exploded perspective view of the dust container cover of FIG. 3.
Figure 7:
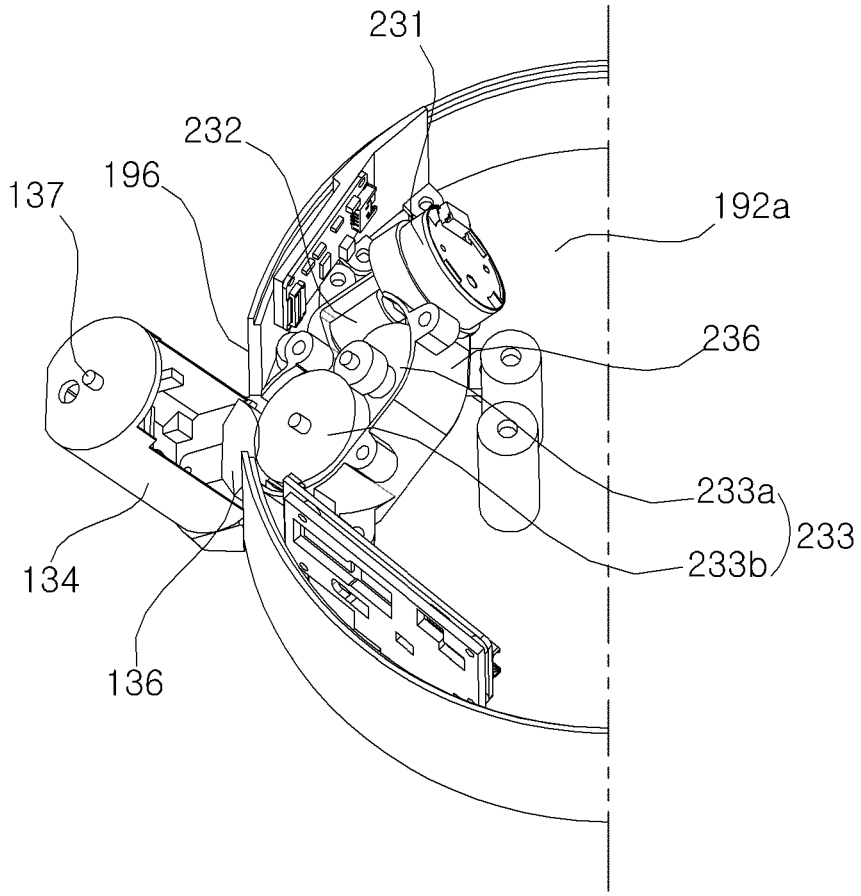
FIG. 7 is a partial perspective view of separating a housing of a driving module in FIG. 6.
Figure 8:
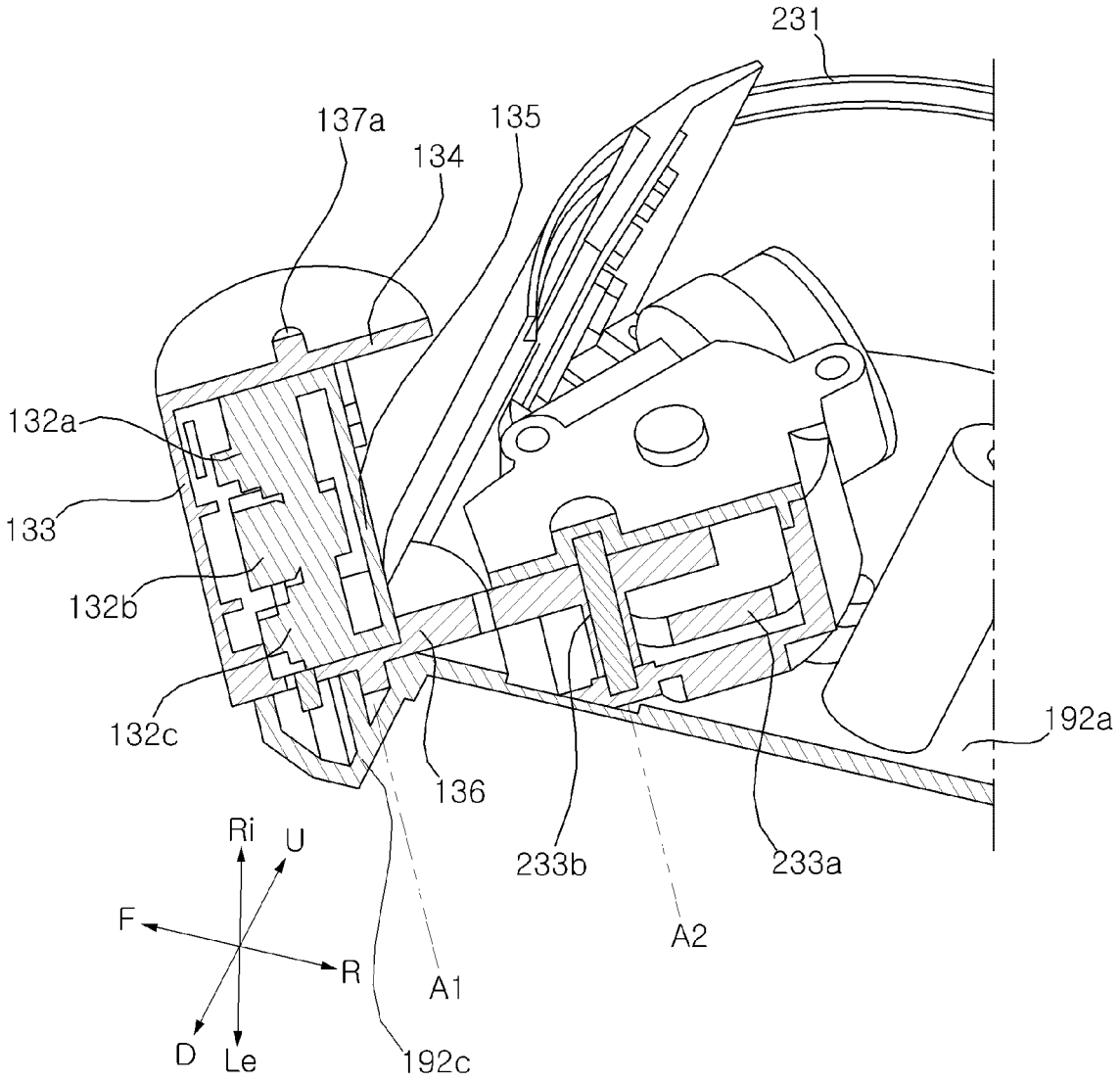
FIG. 8 is a cross-sectional perspective view illustrating a sensing module and a driving module according to an embodiment of the present invention.

Referring to FIGS. 1A and 2, a cleaner 100 includes a cleaner body, a cleaning nozzle 120, a sensing module 130, and a dust container 140. The cleaner body may include a main body 110 for accommodating the dust container 140 and a dust container cover 190 for covering the upper portion of the dust container 140. The cleaner 100 of an embodiment may further include a driving module that rotates the sensing module 130 relatively to the cleaner body and/or the dust container cover 190.

The main body 110 includes various components including a controller (not shown) for controlling the cleaner 100. The main body 110 may form a space for accommodating various components constituting the cleaner 100. The main body 110 may be selected in one of an automatic mode and a manual mode by the user and travel. The main body 110 may be provided with a mode selection input unit for selecting one of the automatic mode and the manual mode. When the user selects the automatic mode in the mode selection input unit, the main body 110 may automatically travel like a robot cleaner. In addition, when the user selects the manual mode in the mode selection input unit, the main body 110 may travel manually by being pulled or pushed by user's force.

The main body 110 is provided with a wheel 150 for moving the main body 110. The wheel 150 may include a motor (not shown) and at least one wheel rotated by the driving force of the motor. The rotation direction of the motor may be controlled by a controller (not shown), and thus, a wheel of the wheel 150 may be configured to be rotatable in one direction or the other direction.

The wheels 150 may be provided in both left and right sides of the main body 110, respectively. The main body 110 may be moved back and forth, left and right by the wheel 150, or rotated. Each of the wheels 150 may be configured to be drivable independently of each other. To this end, each wheel 150 may be driven by a different motor. The controller controls the driving of the wheel 150, so that the cleaner 100 is implemented to autonomously travel on the floor.

The wheel 150 is provided in a lower portion of the main body 110 to move the main body 110. The wheel 150 may be configured only of circular wheels, may be configured by circular rollers which are connected by a belt chain, or may be configured by circular wheels and circular rollers which are connected by a belt chain. The upper portion of the wheel of wheel 150 may be disposed inside the main body 110 and the lower portion thereof may protrude to a lower side of the main body 110. At least the lower portion of the wheel of wheel 150 is provided in contact with the floor surface which is a surface to be cleaned, so that the main body 110 can travel.

The wheels 150 may be installed in the left and right sides of the main body 110, respectively. The wheel 150 disposed in the left side of the main body 110 and the wheel 150 disposed in the right side of the cleaner 100 may be independently driven. That is, the wheels 150 disposed in the left side of the main body 110 may be coupled to each other via at least one first gear, and may be rotated by the driving force of a first traveling motor that rotates the first gear. In addition, the wheel 150 disposed in the right side of the main body 110 may be coupled to each other via at least one second gear, and may be rotated by the driving force of a second traveling motor that rotates the second gear.

The controller may determine the travelling direction of the main body 110 by controlling the rotational speed of each rotating shaft of the first traveling motor and the second traveling motor. For example, when the rotating shafts of the first traveling motor and the second traveling motor are simultaneously rotated at the same speed, the main body 110 can move straight. In addition, when the rotating shafts of the first traveling motor and the second traveling motor are simultaneously rotated at different speeds, the main body 110 can be turned to the left or right. The controller may drive one of the first traveling motor and the second traveling motor and stop the other so as to turn the main body 110 to the left or right.

A suspension unit may be installed inside the main body 110. The suspension unit may include a coil spring. The suspension unit can absorb the shock and vibration transmitted from the wheel 150 during travel of the main body 110 by using an elastic force of the coil spring.

Further, the suspension unit may be provided with an elevating unit for adjusting the height of the main body 110. The elevating unit can be vertically movably installed in the suspension unit and can be coupled to the cleaner 100. Therefore, when the elevating unit is moved upward from the suspension unit, the cleaner 100 can be moved upward together with the elevating unit. When the elevating unit is moved downward from the suspension unit, the cleaner 100 can be moved downward together with the elevating unit. The cleaner 100 may be vertically moved by the elevating unit to adjust the height.

When the main body 110 travels on a hard floor, the bottom surface of the cleaning nozzle 120 may move while being in close contact with the floor surface so that the floor surface can be cleaned. However, when a carpet is laid on the floor surface to be cleaned, slipping may occur in the wheel of wheel 150 so that the traveling performance of the main body 110 may be reduced. In addition, the traveling performance of the main body 110 may be reduced due to the force of sucking the carpet by the cleaning nozzle 120.

However, since the elevating unit adjusts the height of the main body 110 according to the slip rate of the wheel of wheel 150 (the same in below), the degree to which the bottom surface of the cleaning nozzle 120 is in close contact with the surface to be cleaned can be adjusted, so that the traveling performance of the main body 110 can be maintained regardless of the material of the surface to be cleaned.

Meanwhile, if the wheel of wheel 150 disposed in the left side of the main body 110 is coupled to the first traveling motor through the first gear, and if the wheel of wheel 150 disposed in the right side of the main body 110 is coupled to the second traveling motor through the second gear, when the user desires to move the main body 110 in the manual mode in a state in which the first traveling motor and the second traveling motor are stopped, both the wheels of the left and right wheels 150 can not be rotated. Therefore, in the manual mode of the main body 110, the wheels of the left and right wheels 150 and the first and second traveling motors should be disconnected. To this end, it is preferable that a clutch is disposed inside the main body 110 to connect the wheels of the left and right wheels 150 and the first and second traveling motors when the main body 110 is in the automatic mode, and to disconnect the wheels of the left and right wheels 150 and the first and second traveling motors when the main body 110 is in the manual mode.

The main body 110 is equipped with a battery (not shown) for supplying power to an electrical components of the cleaner 100. The battery is configured to be chargeable and detachable from the main body 110. The main body 110 is provided with a dust container accommodating unit 112, and the dust container 140 for separating and collecting dust in the sucked air is detachably coupled to the dust container accommodating unit 112.

The dust container accommodating unit 112 may have a shape opened frontward and upward of the main body 110 and may be recessed from the front F side of the main body 110 to the rear R side. The dust container accommodating unit 112 may be formed such that the front side, the upper side U, and the lower side D of a front portion of the cleaning body 110 are opened.

The dust container accommodating unit 112 may be formed in other position (e.g., behind the main body 110) depending on the type of the cleaner. The dust container 140 is detachably coupled to the dust container accommodating unit 112. A part of the dust container 140 may be accommodated in the dust container accommodating unit 112 and the other part of the dust container 140 may protrude toward the front of the main body 110.

The dust container 140 may be disposed to be shifted toward the front or rear of the cleaner body. Specifically, the dust container 140 may be disposed in the center of the cleaner body (specifically, the main body 110) eccentrically in a front direction or rear direction.

The dust container 140 has a large volume as it is a multi-cyclone type, and it is required to visually recognize the accumulated amount of dust, so that the dust container 140 is exposed in a direction of at least one of a front surface, a side surface, and a rear surface of the cleaner body. Preferably, the dust container 140 is disposed eccentrically toward the front side of the main body and at least a part of the lateral side of the dust container 140 is exposed forward in the cleaner body so as to shorten a flow path connecting the cleaning nozzle 120 protruding from the front surface of the cleaner body with the dust container 140 and minimize the reduction of suction power.

The dust container 140 has an inlet 142 through which the dust-containing air is introduced and an outlet 143 through which the dust-separated air is discharged. When the dust container 140 is installed in the dust container accommodating unit 112, the inlet 142 and the outlet 143 are configured to communicate with a first opening 116 and a second opening 117 formed in the inner lateral side wall of the dust container accommodating unit 112, respectively.

An intake flow path formed in the main body 110 corresponds to a flow path ranging from the cleaning nozzle 120 to the first opening 116, and an exhaust flow path corresponds to a flow path ranging from the second opening 117 to an exhaust port. Based on such a configuration, the dust-containing air introduced through the cleaning nozzle 120 flows into the dust container 140 through the intake air flow path inside the main body 110, and passes through at least one filtering unit (e.g., a cyclone, a filter, etc.) to separate the air and the dust from each other. The dust is collected in the dust container 140 and the air is discharged from the dust container 140, and then finally discharged to the outside through the exhaust port via the exhaust flow path inside the main body 110.

The main body 110 is provided with a dust container cover 190 covering the dust container 140 accommodated in the dust container accommodating unit 112. The dust container cover 190 may be hinged to one side of the main body 110 to be rotatable. The dust container cover 190 may cover the opened upper side of the dust container accommodating unit 112 and cover the upper side of the dust container 140. In addition, the dust container cover 190 may be configured to be detachable from the main body 110.

The separation of the dust container 140 from the dust container accommodating unit 112 may be restricted in a state in which the dust container cover 190 is disposed to cover the dust container 140. The dust container cover 190 is rotatably coupled to the main body 110 by a hinge 194. The hinge 194 may be disposed such that the dust container cover 190 can be rotated about an axis parallel to the horizontal direction (in detail, the left-right direction LeRi).

The dust container cover 190 may be composed of a single component, and the dust container cover 190 of the embodiment may include an upper dust container cover 191 and a lower dust container cover 192. The configuration of the dust container cover 190 will be described later.

A coupling protrusion (not shown) protrudes from the bottom surface of the dust container cover 190 and a coupling groove 141 to which the coupling protrusion is inserted into and coupled is formed in the upper surface of the dust container 140. When the dust container cover 190 covers the upper side of the dust container accommodating unit 112, the coupling protrusion is inserted into the coupling groove 141. Accordingly, the dust container 140 is coupled to the dust container cover 190 and is not removable from the main body 110. On the other hand, when the dust container cover 190 opens the upper side of the dust container accommodating unit 112, the coupling protrusion comes out of the coupling groove 141, so that the dust container 140 is disconnected from the dust container cover 190 and can be detachable from the main body 110.

A handle 114 is provided in the upper end of the dust container cover 190. The handle 114 may be provided with a photographing unit 115. At this time, it is preferable that the photographing unit 115 is disposed to be inclined with respect to the bottom surface of the main body 110 so that the photographing unit 115 can photograph both the front side and the upper side together.

The photographing unit 115 may be provided in the main body 110 to photograph an image for simultaneous localization and mapping (SLAM) of the cleaner. The image photographed by the photographing unit 115 is used to generate a map of the traveling area or to detect the current position in the traveling area.

The photographing unit 115 may generate three-dimensional coordinate information related to the surroundings of the main body 110. That is, the photographing unit 115 may be a 3D Depth Camera that calculates the distance between the cleaner 100 and an object to be photographed. Accordingly, field data for three-dimensional coordinate information may be generated.

Specifically, the photographing unit 115 may photograph a two-dimensional image related to the surroundings of the main body 110, and may generate a plurality of three-dimensional coordinate information corresponding to the photographed two-dimensional image.

In an embodiment, the photographing unit 115 may include two or more cameras that obtain an existing two-dimensional image, and may achieve a stereoscopic vision scheme that generates three-dimensional coordinate information by combining two or more images obtained from two or more cameras. Specifically, the photographing unit 115 according to the embodiment may include a first pattern irradiating unit for irradiating light of a first pattern downward toward the front side of the main body, a second pattern irradiating unit for irradiating light of a second pattern upward toward the front side of the main body 2, and an image acquiring unit for acquiring an image of the front side of the main body. Thus, the image acquiring unit may acquire an image of an area to which light of the first pattern and light of the second pattern are emitted.

In another embodiment, the photographing unit 115 may include an infrared ray pattern irradiating unit for irradiating an infrared ray pattern together with a single camera, and captures the shape of the infrared ray pattern, irradiated by the infrared ray pattern irradiating unit, projected onto an object to be photographed so that the distance between the photographing unit 115 and the object to be photographed can be measured. The photographing unit 115 may be an Infra Red (IR) type photographing unit 115.

In another embodiment, the photographing unit 115 may include a light emitting unit that emits light together with a single camera, may receive a part of the laser, emitted from the light emitting unit, reflected from the object to be photographed, and may analyze the received laser, so that the distance between the photographing unit 115 and the object to be photographed can be measured. The photographing unit 115 may be an time-of-flight (TOF) type photographing unit 115.

Specifically, the laser of the above mentioned photographing unit 115 is configured to irradiate a laser extending in at least one direction. In one example, the photographing unit 115 may include first and second lasers, and the first laser may irradiate linear lasers intersected with each other and the second laser may irradiate a single linear laser. According to this, the lowermost laser is used to detect obstacles in the floor, the uppermost laser is used to detect obstacles in the upper portion, and the intermediate laser between the lowermost laser and the uppermost laser detects an obstacle in the middle portion.

The sensing module 130 may be disposed below the dust container cover 190 and the sensing module 130 may be detachably coupled to the dust container 140. The sensing module 130 is disposed in the main body 110 and detects information related to the environment where the main body 110 is positioned. The sensing module 130 detects information related to the environment to generate field data.

The sensing module 130 detects surrounding features (including obstacles) so that the cleaner 100 does not collides with the obstacle. The sensing module 130 may sense information on the outside of the cleaner 100. The sensing module 130 may detect a user in the vicinity of the cleaner 100. The sensing module 130 may detect an object in the vicinity of the cleaner 100. In addition, the sensing module 130 is configured to be able to accomplish panning (move to left and right) and tilting (disposed to be inclined up and down) in order to improve the detecting function of the cleaner and the traveling function of the robot cleaner.

The sensing module 130 is disposed in the front side of the main body 110 and disposed between the dust container 140 and the handle 114. The sensing module 130 may include at least one of an external signal sensor, an obstacle sensor, a cliff sensor, a lower camera sensor, an upper camera sensor, an encoder, a shock sensor, and a microphone.

The external signal sensor can detect an external signal of the cleaner 100. The external signal sensor may be, for example, an infrared ray sensor, an ultrasonic sensor, a Radio Frequency (RF) sensor, or the like. Thus, field data for the external signal may be generated.

The cleaner 100 may receive a guide signal generated by a charging signal by using the external signal sensor and detect information on the position and the direction of the charging base. At this time, the charging base may transmit a guide signal indicating the direction and the distance so that the cleaner 100 can return. That is, the cleaner 100 may receive a signal transmitted from the charging base, determine the current position, and set the moving direction so that it can return to the charging base.

The obstacle sensor can detect an obstacle ahead. Thus, field data for the obstacle is generated. The obstacle sensor may detect an object existing in the moving direction of the cleaner 100 and may transmit the generated field data to the controller. That is, the obstacle sensor can detect protrusions existing on the moving path of the cleaner 100, furnishings in the house, furniture, wall, wall corner, and the like, and transmit the field data to the controller.

The obstacle sensor may be, for example, an infrared sensor, an ultrasonic sensor, a RF sensor, a geomagnetic sensor, and the like. The cleaner 100 may use one type of sensor as an obstacle sensor or use two or more types of sensors together as needed.

The cliff sensor can detect obstacles on the floor supporting the main body 110 by mainly using various types of optical sensors. Thus, field data for an obstacle on the floor is generated. The cliff sensor may be, like an obstacle sensor, an infrared sensor having a light emitting unit and a light receiving unit, an ultrasonic sensor, an RF sensor, a position sensitive detector (PSD) sensor, or the like.

For example, the cliff sensor may be a PSD sensor, but it may be composed of a plurality of different types of sensors. The PSD sensor has a light emitting unit that emits infrared rays to an obstacle, and a light receiving unit that receives infrared rays that are reflected from the obstacle and is returned, and is generally configured in the form of a module. When an obstacle is detected by using the PSD sensor, a stable measurement value can be obtained irrespective of the reflectance and the color difference of the obstacle.

The controller may measure an infrared angle between a light emitting signal of the infrared ray emitted by the cliff sensor toward the ground and a reflection signal received after being reflected by the obstacle so that it can detect the cliff and acquire the field data of the depth.

A lower camera sensor acquires image information (field data) about the surface to be cleaned while the cleaner 100 is moving. The lower camera sensor is also referred to as an optical flow sensor. The lower camera sensor may convert a lower side image inputted from an image sensor provided in the sensor to generate image data (field data) of a certain format. Field data for an image recognized through the lower camera sensor can be generated.

By using the lower camera sensor, the controller may detect the position of a mobile robot irrespective of the slip of the mobile robot. The controller may compare and analyze the image data photographed by the lower camera sensor according to time and calculate the movement distance and the movement direction, and calculate the position of the mobile robot based on the calculated movement distance and the movement direction.

An upper camera sensor may be installed to face the upper side or the front side of the cleaner 100 to photograph the vicinity of the cleaner 100. When the cleaner 100 includes a plurality of upper camera sensors, the camera sensors may be formed in the upper side or lateral side surface of the mobile robot at a certain distance or at a certain angle. Field data for an image recognized through the upper camera sensor may be generated.

The encoder may detect information related to the operation of the motor that drives the wheel of the wheel 150.

Thus, field data on the operation of the motor is generated. The shock sensor may detect a shock when the cleaner 100 collides with an external obstacle or the like. Thus, field data on an external shock is generated. The microphone may detect an external sound. Accordingly, field data for the external sound is generated.

In the present embodiment, the sensing module 130 includes an image sensor. In the present embodiment, the field data is image information acquired by the image sensor or feature point information extracted from the image information, but it is not necessarily limited thereto.

Meanwhile, a cable adaptor (not shown) may be disposed in the open lower side of the dust container accommodating unit 112. The cable adaptor may be coupled to the main body 110 to form a part of the main body 110. That is, when the cable adaptor is coupled to the main body 110, the cable adaptor may be considered as the same configuration as that of the main body 110. The dust container 140 for storing foreign matter may be placed on the cable adaptor. The cable adaptor may connect the main body 110 and the cleaning nozzle 120. The cable adaptor may connect the intake flow path of the main body 110 and the intake flow path of the cleaning nozzle 120.

The cleaning nozzle 120 is configured to suck the dust-containing air or to wipe the floor. Here, the cleaning nozzle 120 for sucking the dust-containing air may be referred to as a suction module, and the cleaning nozzle 120 for wiping the floor may be referred to as a mop module.

The cleaning nozzle 120 may be detachably coupled to the main body 110. When the suction module is detached from the main body 110, the mop module may be detachably coupled to the main body 110 in place of the detached suction module. Accordingly, when a user desires to remove the dust on the floor, the suction module is mounted in the main body 110, and when the user desires to wipe the floor, the mop module may be mounted in the main body 110.

The cleaning nozzle 120 may be configured to have a function of wiping the floor after sucking the dust-containing air. The cleaning nozzle 120 may be disposed below the main body 110 or may protrude from one side of the main body 110 as shown in the drawing. One side of the main body 110 may be a side in which the main body 110 travels in the forward direction, i.e., the front portion of the main body 110. The cleaning nozzle 120 may be disposed forward of the wheel 150, and a part of the cleaning nozzle 120 may protrude forward of the dust container 140.

In the drawing, it is shown that the cleaning nozzle 120 protrudes from one side of the main body 110 to the front side and to both the left and right sides. Specifically, the front end portion of the cleaning nozzle 120 is disposed in a position spaced forward from one side of the main body 110, and the left and right end portions of the cleaning nozzle 120 are disposed to be spaced apart from one side of the main body 110 to the left and right sides of the main body 110.

A suction motor may be installed inside the main body 110. An impeller (not shown) may be coupled to the rotating shaft of the suction motor. When the suction motor is driven so that the impeller is rotated together with the rotating shaft, the impeller can generate a suction force.

An intake flow path may be formed in the main body 110. Foreign matter such as dust flows into the cleaning nozzle 120, from the surface to be cleaned, by the suction force generated by the driving force of the suction motor, and the foreign matter introduced into the cleaning nozzle 120 may be introduced into the intake flow path.

The cleaning nozzle 120 may clean the floor surface to be cleaned when the main body 110 travels in the automatic mode. The cleaning nozzle 120 may be disposed adjacent to the floor surface among the front side surface of the main body 110. A suction port for suctioning air may be formed on the bottom surface of the cleaning nozzle 120. When the cleaning nozzle 120 is coupled to the main body 110, the suction port may be disposed toward the floor surface.

The cleaning nozzle 120 may be coupled to the main body 110 through a cable adaptor. The cleaning nozzle 120 may communicate with the intake flow path of the main body 110 through the cable adaptor. The cleaning nozzle 120 may be disposed below the dust container 140 disposed in the front portion of the main body 110.

The cleaning nozzle 120 may include a case having a suction port formed in a bottom surface thereof, and a brush unit may be rotatably installed in the case. The case may provide an empty space so that the brush unit can be rotatably installed therein. The brush unit may include a rotating shaft formed to be long in the left and right direction and a brush protruded to an outer circumference of the rotating shaft. The rotating shaft of the brush unit may be rotatably coupled to the left and right side surfaces of the case.

The brush unit is disposed such that the brush protrudes through the suction port formed in the bottom of the case. When the suction motor is driven, the brush unit is rotated by the suction force and can sweep upward dust and other foreign matter on the floor surface to be cleaned. The swept foreign matter may be sucked into the case by the suction force. Preferably, the brush is formed of a material that does not generate triboelectricity (e.g., electrical charge generated by friction) so that foreign matter cannot easily adhere thereto.

The cable adaptor may be coupled to the front surface of the main body 110. The cable adaptor may connect the main body 110 and the cleaning nozzle 120. The cleaning nozzle 120 may be detachably coupled to the cable adaptor. The cable adaptor can support the lower side of the dust container 140.

The dust container 140 may be detachably coupled to the front surface of the main body 110, and the lower side may be supported by the cable adaptor. The dust container 140 may include a hollow cylindrical case. In the interior of the cylindrical case, a filter unit for separating foreign matter and air from the air sucked through the intake flow path of the main body 110 may be disposed.

The filter unit may include a plurality of cyclones. Foreign matter including the dust filtered in the filter unit may be dropped and accommodated in the dust container 140. Only air may be discharged outside the dust container 140, and moved to the suction motor side by the suction force of the suction motor, and then may be escaped to the outside of the body 110.

The lower side of the dust container 140 may be opened and the lower side of the opened dust container 140 may be covered by a lid 145. One side of the lid 145 may be rotatably coupled to the dust container 140 to be opened and closed. When the lid 145 is opened, the opened lower side of the dust container 140 may be opened, and the foreign matter accommodated in the dust container 140 may be dropped through the opened lower side of the dust container 140. The user may separate the dust container 140 from the main body 110 and then open the lid to discard the foreign matter accommodated in the dust container 140. When the dust container 140 is coupled to the main body 110, the dust container 140 is placed on the cable adaptor. That is, the lid of the dust container 140 is placed on the upper side of the cable adaptor.

As described above, the cleaning nozzle 120 is provided in a state of being in close contact with the floor surface to be cleaned, so that the floor surface can be automatically cleaned when the main body 110 travels in the automatic mode. However, when a user desires to manually perform the cleaning, the user may input a manual mode travel of the main body 110 through the mode selection input unit provided in the main body 110, and then detach the cleaning nozzle 120 from the main body 110, and may couple a manual cleaning nozzle to the main body 110 to perform manual cleaning. The manual cleaning nozzle may include a long hose in the form of a bellows. In this case, the hose portion of the manual cleaning nozzle may be coupled to the main body 110.

Meanwhile, the cleaner 100 according to the embodiment of the present invention may relatively rotate the sensing module 130 with respect to the dust container cover 190, thereby detecting an obstacle in the left and right direction quickly and accurately.

Hereinafter, the sensing module 130, the driving module, and the dust container cover 190 to which the sensing module 130 and the driving module are coupled will be described in detail. Referring to FIGS. 3 to 8, the sensing module 130 may be mounted in the cleaner body rotatably around a rotating shaft that intersects the horizontal direction. The sensing module 130 may include at least one sensor unit 132. The sensor unit 132 is disposed along the vertical direction on the side surface of the main body 110. The sensing module 130 includes a first laser 132*a*, a second laser 132*b*, and a camera 132*c*.

The first laser 132*a* irradiates laser toward the front lower side of the cleaner 100 and the second laser 132*b* irradiates laser toward the front upper side of the cleaner 100. The first laser 132*a* and the second laser 132*b* may be disposed in a line along the vertical direction. In the drawing, it is shown that the second laser 132*b* is disposed below the first laser 132*a*. Obviously, the first laser 132*a* and the second laser 132*b* can irradiate the laser toward the direction orthogonal to the rotating shaft A1 of the sensing module 130.

The camera 132*c* is configured to photograph the laser irradiated by the first laser 132*a* and the second laser 132*b* within a preset photographing area. The preset photographing area includes an area ranging from the floor to the upper end of the robot cleaner 100. Therefore, the obstacle ahead of the robot cleaner 100 may be detected, and the problem that the robot cleaner 100 collides with or is caught in the upper obstacle can be prevented. The camera 132*c* can irradiate the laser toward the direction orthogonal to the rotating shaft A1 of the sensing module 130.

The set photographing area may be, for example, an angle of view of 105 degrees in an up and down direction (i.e., vertical direction), an angle of view of 135 degrees in a left and right direction (i.e., horizontal direction), and an area within 25 meters. The preset photographing area may be changed by various factors such as the installation position of the first and second lasers 132*a* and 132*b*, the irradiation angle of the first and second lasers 132*a* and 132*b*, the height of the robot cleaner 100, and the like.

The first laser 132*a*, the second laser 132*b*, and the camera 132*c* may be disposed in a line along the vertical direction of the main body 110. In the drawing, it is shown that the camera 132*c* is disposed below the second laser 132*b*. An arbitrary line connecting the first laser 132*a*, the second laser 132*b*, and the camera 132*c* may be disposed parallel to the rotating shaft A1 of the sensing module 130. Hereinafter, the term "parallel" does not mean a perfect parallel in a mathematical sense but means parallel in a range including an error in an engineering sense.

The irradiation direction of the first laser 132*a*, the second laser 132*b*, and the camera 132*c* may be a direction between a forward direction and a downward direction. The irradiation direction of the first laser 132*a*, the second laser 132*b*, and the camera 132*c* may be disposed to be inclined downwardly forward with respect to the dust container cover 190. Accordingly, the sensing module 130 may detect the forward and downward sides.

The sensing module 130 further includes a window 133, a sensor case 134, and a sensor gear 136. The window 133 is disposed to cover the first laser 132*a*, the second laser 132*b*, and the camera 132*c*, and has a transparency. Here, the term "transparency" means a property of transmitting at least a part of incident light, and includes a concept of semi-transparency.

The window 133 may be formed of a synthetic resin material or a glass material. When the window 133 is semi-transparency, a material itself may be formed to have semi-transparency, or the material itself may be formed to have transparency and a film attached to the material may have semi-transparency.

The sensor case 134 is configured to fix the sensor unit and the window 133. As shown, the sensor case 134 is configured to accommodate at least a part of the window 133. The sensor case 134 may be formed of a synthetic resin material or a metal material, and may be opaque.

As another example, the window may be provided in the dust container cover 190 and may cover at least the front side and the lateral side of the sensor case 134. The window 133 may be rotated together with the sensor case 134, and may not be affected by the rotation of the sensor case 134 when it is installed in the dust container cover 190.

When the angle of view in the left and right direction (i.e., the horizontal direction) of the sensing module 130 is 135 degrees, but the sensing module 130 partially recognizes the left and right ends of an obstacle, the sensing module 130 can not determine whether it is an obstacle, and can not determine the obstacle quickly and accurately during the rotation motion or direction change of the cleaner due to the narrow angle of view. In order to solve such a problem, the embodiment can rotate the sensing module 130 in the left-right direction through the rotation module.

The sensor case 134 may accommodate the sensor unit and may be rotatably coupled to the dust container 140 cover of the cleaner body. When the sensor case 134 is rotated, the sensor unit 132 is restrained by the rotation of the sensor case 134 and rotated together.

Specifically, the sensor shaft (or axial protrusions) AI may be formed in the sensor case 134. The sensor case 134 is rotated about the sensor shaft A1. The sensor shaft A1 may be coupled to the upper and lower ends of the sensor case 134, respectively. Each sensor shaft A1 is rotatably coupled to the dust container cover 190.

The sensor shaft A1 may be disposed in parallel with the up and down direction or may have a preset inclination with respect to the up and down direction. The upper portion of the sensor shaft A1 may be positioned forward of the lower portion. Therefore, when the sensing module 130 is rotated about the sensor shaft A1, the floor in the front side and lateral side of the cleaner body and a remote area can be detected at the same time.

The sensor gear 136 is coupled to the sensor case 134 and is rotated about the same axis as the sensor shaft A1, and receives the driving force of the driving module 200. The sensor gear 136 receives the driving force from the driving module 200 and rotates the sensor case 134 about the sensor shaft A1. The sensor gear 136 is coupled to the sensor case 134 and/or the sensor shaft A1.

At least a part of the sensing module 130 may be exposed to the front of the cover of the dust container 140. Specifically, a part of the sensor case 134 and the window may be exposed to the front of the dust container 140 cover. Accordingly, even if the sensing module 130 is rotated, the angle of view of the sensing module 130 is not restricted by the cover of the dust container 140. The front end of the sensor case 134 preferably protrudes forward from the front end of the cover of the dust container 140.

The sensing module 130 is disposed to protrude forward from the dust container cover 190 and the main body 110 so that the angle of view can be prevented from being obscured by the cleaner when the ambient environment is detected. The sensing module 130 may be positioned in front of the driving module 200.

The dust container cover 190 may be installed such that the sensing module 130 is exposed to the front side, or to the front side and lateral side and the sensing module 130 is rotated. The dust container 140 cover may define a space for accommodating the driving module 200 therein. Specifically, the dust container cover 190 may include a lower dust container cover 192 hinged to the cleaner body, and an upper dust container cover 191 coupled to the lower dust container cover 192 and coupled to the handle 114.

The lower dust container cover 192 is coupled to the upper dust container cover 191 and defines at least a part of the lower and outer appearance of the dust container cover 190. A hinge 194 is formed in the lower dust container cover 192. The lower dust container cover 192 may define a accommodating unit 193 for accommodating the driving module 200 together with the upper dust container cover 191.

The lower dust container cover 192 may include a cover bottom surface 192*a* that forms a bottom and a cover lateral side surface 192*b* that extends from the edge of the bottom surface to intersect the bottom surface. The accommodating unit 193 is a space defined by a cover bottom surface 192*a* and the cover lateral side surface 192*b*. The driving module 200 is fixed to the cover bottom surface 192*a* as described later.

A power supply unit for supplying power to the sensing module 130 may be accommodated in the accommodating unit 193. Specifically, the power supply unit may include a circuit board and may be coupled to the cover lateral side surface 192*b*. The power supply unit and the sensing module 130 may be connected by a flexible circuit board. Therefore, when the sensing module 130 is rotated, there is less possibility of power failure.

A lower shaft coupling unit 192*c* which protrudes forward of the cover lateral side surface 192*b* from the cover bottom surface 192*a* and to which the sensor shaft A1 is rotatably coupled may be formed in the upper dust container cover 191. The lower shaft coupling unit 192*c* protrudes forward of the cover lateral side surface 192*b* so that the cover lateral side surface 192*b* does not restrict the angle of view when the sensing module 130 is rotated.

In addition, a connection groove 196 having an opened area adjacent to the lower shaft coupling unit 192*c* may be formed in the cover lateral side surface 192*b*. The connection groove 196 provides a space in which the sensor gear 136 and the gear of the driving module 200 are connected.

The upper dust container cover 191 is coupled to the upper portion of the lower dust container cover 192 and defines a part of the upper and side outer appearance of the dust container cover 190. The upper dust container cover 191 may be formed with an upper shaft coupling unit 191*a* which protrudes forward from the upper dust container cover 191 in the upper dust container cover 191 and is rotatably coupled with the sensor shaft A1. The upper shaft coupling unit 191*a* protrudes forward of the upper dust container cover 191 so that the cover lateral side surface 192*b* does not restrict the angle of view when the sensing module 130 is rotated.

The sensor case 134 may be blocked in the direction excluding the front direction by the dust container cover 190 and/or the handle 114. The sensing module 130 and the driving module 200 may be constrained by the rotation of the dust container cover 190 and rotated together. At this time, the rotation direction of the sensing module 130 and the rotation direction of the dust container cover 190 may be intersected with each other. Specifically, the direction of the sensor shaft A1 of the sensing module 130 may be parallel to the direction intersecting the rotating shaft of the dust container cover 190. The rotating shaft A1 of the sensing module 130 may extend in the vertical direction and the rotating shaft of the dust container cover 190 may extend in the left and right direction.

The driving module 200 may relatively rotate the sensing module 130 with respect to the cleaner body and/or the dust container cover 190. The sensing module 130 and the driving module 200 may be disposed between the dust container 140 and the handle 114. The sensing module 130 and the driving module 200 may be disposed above the dust container 140. The driving module 200 may relatively tilt the sensing module 130 to the left and right with respect to the main body 110.

The tilting angle of the sensing module 130 may be 45 degrees for left and right sides around the front side respectively. The driving module 200 may rotate the sensing module 130 in place. Here, the expression "rotate in place" means that the position of the rotating shaft A1 of the sensing module 130 is overlapped with the center of the sensing module 130, so that the sensing module 130 is not moved during rotation.

Specifically, the driving module 200 may be disposed between the upper dust container cover 191 and the lower dust container cover 192, and the whole driving module 200 is disposed inside the dust container cover 190. The driving module 200 is eccentrically positioned from the rotating shaft A1 of the sensing module 130, so that the height of the cleaner can be reduced.

The driving module 200 is fixed to the cleaner body. Specifically, the driving module 200 may be fixed to the dust container cover 190. Preferably, the driving module 200 may be coupled to the cover 191 of the lower dust container 140 by a fastening member.

For example, the driving module 200 may include a driving motor 231 for supplying a driving force, at least one connecting gear 233 which is rotated by receiving the driving force of the driving motor 231 and transmits the driving force of the driving motor 231, and a housing 236 for accommodating the driving motor 231 and the connecting gear 233.

When the rotating shaft of the driving motor 231 extends in the vertical direction, the thickness of the cover of the dust container 140 may be increased. Therefore, the rotating shaft of the driving motor 231 can be disposed to be parallel to the horizontal direction.

The rotating shaft of the driving motor 231 may be disposed parallel to the bottom surface of the cover of the dust container 140. Therefore, the thickness of the cover of the dust container 140 is prevented from being increased due to the driving motor 231. A worm gear 232 is coupled to the rotating shaft of the driving motor 231. The worm gear 232 is coupled to the connecting gear 233 having a rotating shaft parallel to a direction intersecting the rotating shaft of the driving motor 231.

The connecting gear 233 transmits the driving force of the driving motor 231 to the sensing module 130. The connecting gear 233 is gear-coupled to the worm gear 232 of the driving motor 231 and the sensor gear 136 of the sensing module 130. A plurality of connecting gears 233 may be disposed to adjust a rotation speed difference between the sensing module 130 and the driving motor 231. The rotating shaft of the connecting gear 233 may be disposed parallel to the rotating shaft A1 of the sensor gear 136 of the sensing module 130.

Figure 14:
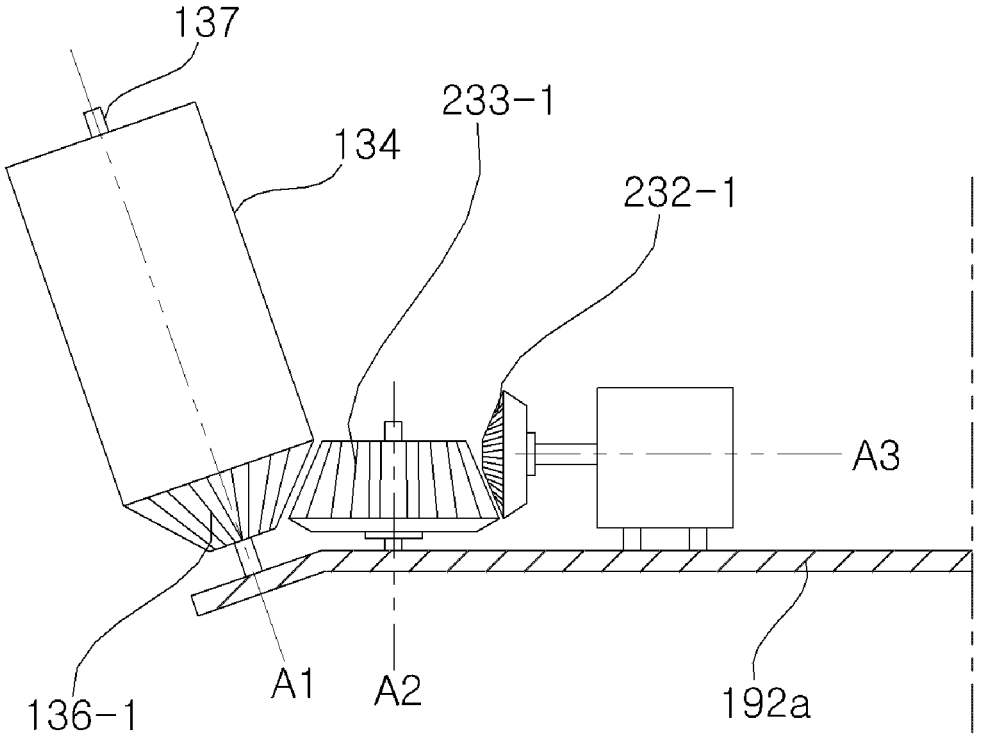
FIG. 14 is a conceptual diagram illustrating a connection between a sensing module and a driving module according to another embodiment of the present invention.

More specifically, an upper portion of the rotating shaft A1 of the sensor gear 136 may have an angle inclined by 20 to 45 degrees in the forward direction in the vertical direction, and the rotating shaft A2 of the connecting gear 233 may be disposed in parallel to the rotating shaft A1 of the sensor gear 136. At this time, the connecting gear 233 may include a spur gear. Obviously, in another embodiment, as shown in FIG. 14, the rotating shaft A2 of the connecting gear 233 and the rotating shaft A1 of the sensor gear 136 may not be disposed in parallel with each other.

A position recognition unit 239 is a sensing target of a sensor position detecting module 240 that senses the position of the sensing module 130 which will be described later. The position recognition unit 239 blocks a light emitted from the sensor position detecting module 240.

Specifically, the position recognition unit 239 may be defined in a path that moves between a light emitting unit 241 and a light receiving unit 242 of the sensor position detecting module 240. Although the position recognition unit 239 may be installed in the sensing module 130, since the sensing module 130 protrudes forward, it is difficult to dispose the sensor position detecting module 240. Therefore, the position recognition unit 239 may be installed in the connecting gear 233.

The position recognition unit (or position sensor) 239 is disposed in the connecting gear 233 and is rotated together with the connecting gear 233, and enables to recognize the rotation angle of the sensing module 130. The position recognition unit 239 protrudes from the connecting gear 233 in the direction of the rotating shaft A2 of the connecting gear 233, and is positioned in an eccentric point from the rotating shaft A2 of the connecting gear 233. When the connecting gear 233 is rotated, the position recognition unit 239 is also rotated so that the position recognition unit 239 rotates along a circular track. The sensor position detecting module 240 may be disposed in a circular track defined by the position recognition unit 239.

Preferably, at least two position recognition units 239 may be provided spaced apart from each other. The plurality of position recognition units 239 may be disposed in the same distance from the rotating shaft of the connecting gear 233. The position recognition unit 239 includes a material for shielding light emitted from the sensor position detecting module 240.

The housing 236 receives the driving motor 231 and the connecting gear 233 and is coupled to the lower dust container cover 192. The embodiment may further include the sensor position detecting module 240 that detect the position of the sensing module 130. The sensor position detecting module 240 can determine the position of the position recognition unit 239 by an optical method. Specifically, the sensor position detecting module 240 may include a photo interrupter installed in the dust container cover 190 to detect the rotational position of the driving module 200.

Figure 13:
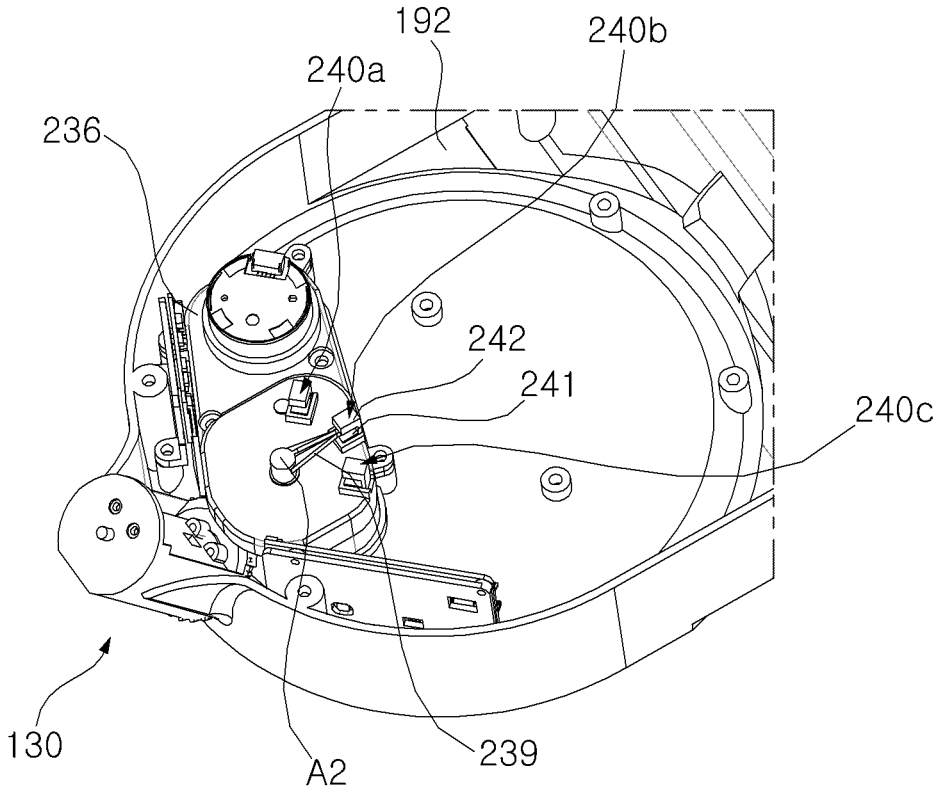
FIG. 13 is a diagram illustrating a position recognition unit and a sensor position detecting module according to another embodiment of the present invention.

More specifically, the photo interrupter may includes a light emitting unit 241 for emitting light to a path on which the position recognition unit 239 moves, and a light receiving unit 242 for detecting the light emitted from the light emitting unit 241 (see FIG. 13). When the position recognition unit 239 is positioned in an arbitrary position, it blocks the light emitted from the light emitting unit 241, so that the photo interrupter can determine the position of the sensing module 130.

Preferably, the photo interrupter is installed in the lower dust container cover 192 or the housing 236, and the light emitting unit 241 and the light receiving unit 242 may be disposed to overlap with a track on which the position recognition unit 239 moves in the direction intersecting the track on which the position recognition unit 239 moves. That is, a circular track on which the position recognition unit 239 moves may be positioned between the light emitting unit 241 and the light receiving unit 242.

Figure 9:
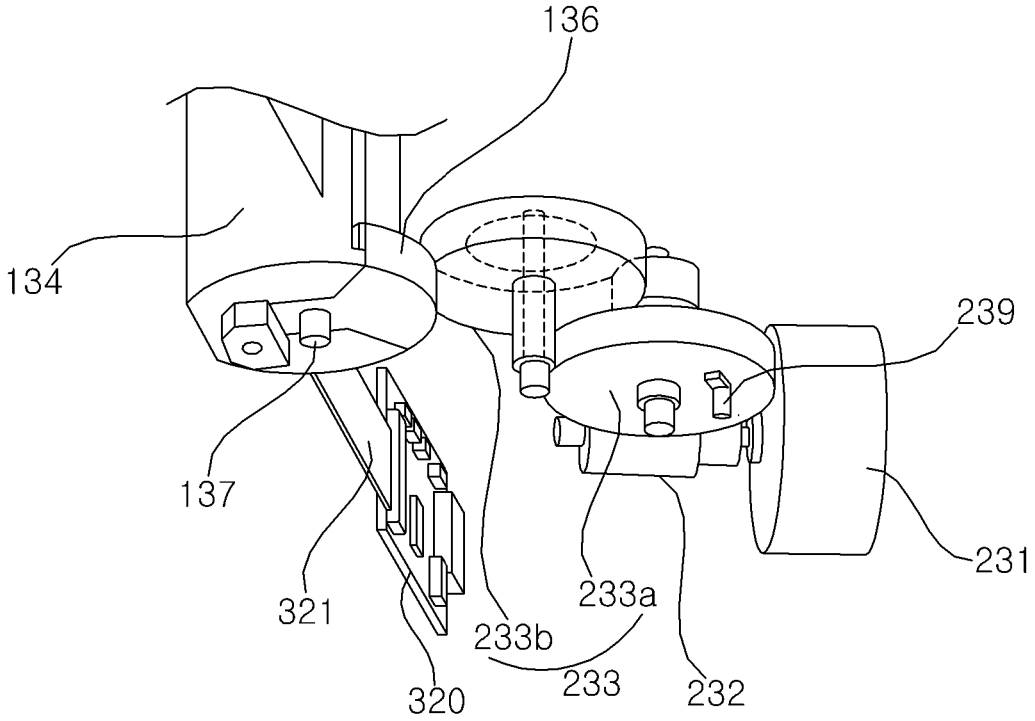
FIG. 9 is a conceptual diagram illustrating a connection between a sensing module and a driving module according to an embodiment of the present invention.
Figure 10:
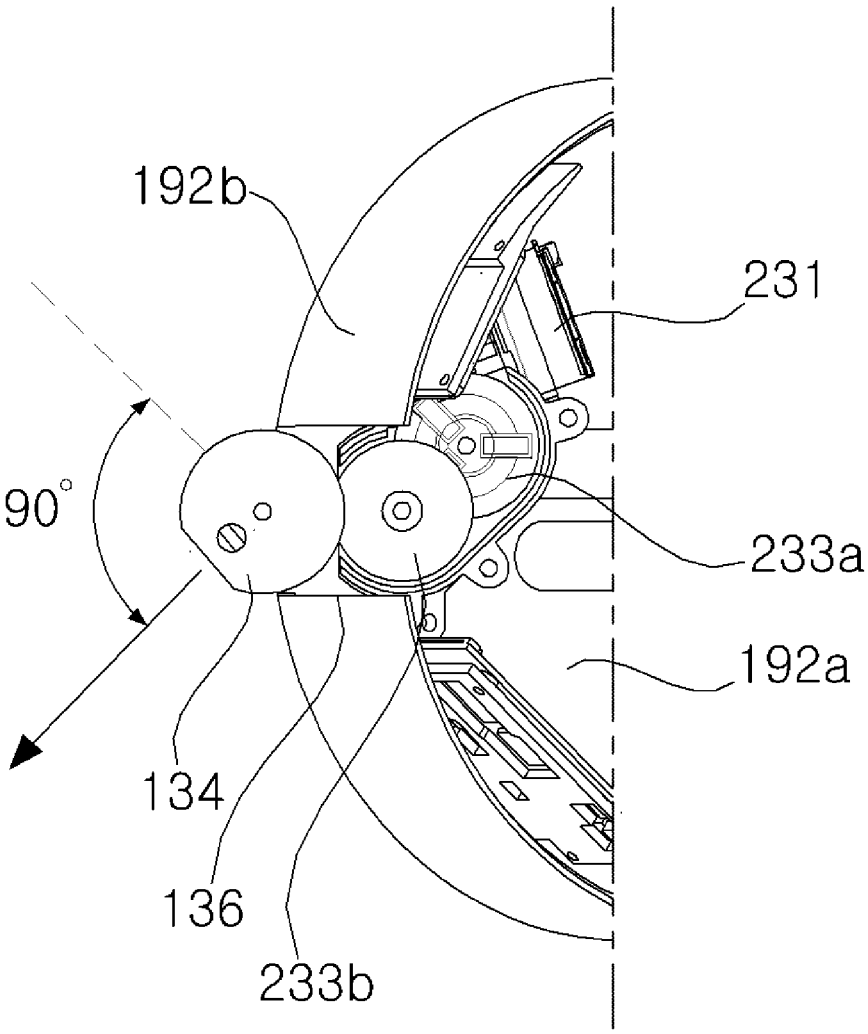
FIG. 10 is a diagram illustrating a state in which the sensing module is rotated in FIG. 9.
Figure 11:
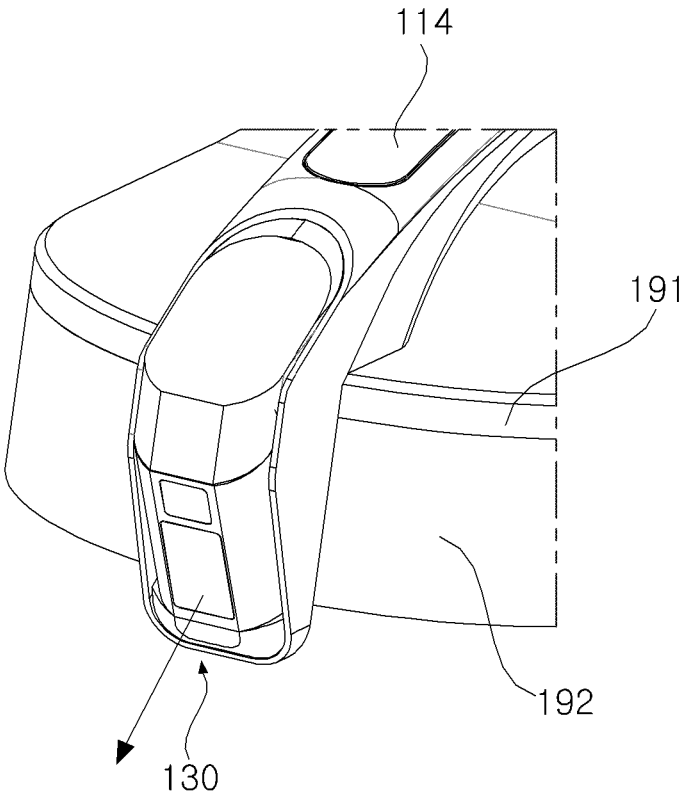
FIG. 11 is an external perspective view of a dust container cover in a state in which the sensing module faces forward.
Figure 12:
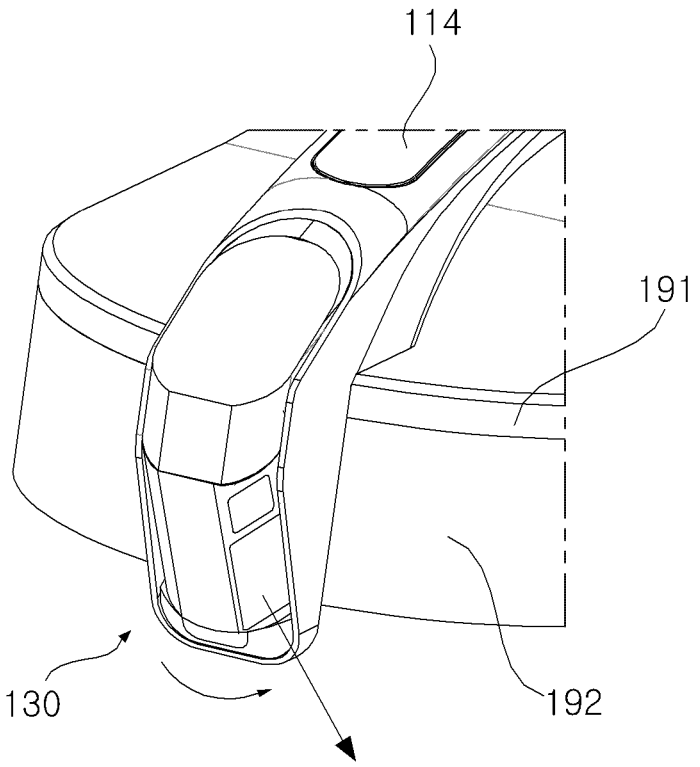
FIG. 12 is a diagram illustrating a sensing module rotated in the lateral direction in FIG. 11.

FIG. 10 is a diagram illustrating a state in which the sensing module 130 is rotated in FIG. 9, FIG. 11 is an external perspective view of a dust container 140 cover in a state in which the sensing module 130 faces forward, and FIG. 12 is a diagram illustrating a sensing module 130 rotated in the lateral direction in FIG. 11.

As shown in FIGS. 10 and 11, the sensing module 130 is positioned to face forward from the rotating shaft A1 of the sensing module 130 during the straight traveling of the cleaner or in a normal state. Obviously, the window 133 formed in the sensor case 134 is also positioned to face forward.

The controller may rotate the sensing module 130, when the cleaner body rotates, changes direction, or needs to collect environment information on the lateral side. Specifically, when the driving motor 231 is rotated, the worm gear 232 and the connecting gear 233 are rotated, and the sensor gear 136 interlocked to the connecting gear 233 is rotated. When the sensor gear 136 is rotated, the sensor case 134 constrained to the sensor gear 136 is rotated together with the sensor unit 132.

Even if the sensing module 130 is rotated on the dust container 140 cover, the dust container cover 190 and the grip 114 are not rotated. Therefore, the dust container cover 190 can be opened by holding the handle 114 even when the sensing module 130 is positioned to face the lateral side.

FIG. 13 is a diagram illustrating a position recognition unit 239 and a sensor position detecting module according to another embodiment of the present invention. Referring to FIG. 13, in comparison with FIGS. 1 to 9, the cleaner of another embodiment has a difference in the disposition and the shape of the position recognition unit 239 and the sensor position detecting module. Hereinafter, the difference of FIG. 9 will be mainly described.

The position recognition unit 239 of another embodiment is positioned outside the housing 236. The position recognition unit 239 is coupled to the rotating shaft of the connecting gear and extends in the radial direction. The position recognition unit 239 is constrained to the rotation of the connecting gear 233 in the form of a bar. The position recognition unit 239 is coupled to the rotating shaft A2 of the connecting gear 233 exposed to the outside of the housing 236.

The sensor position detecting module is coupled to the outer surface of the housing 236 and may be disposed in the movement path of the position recognition unit 239. The light emitting unit 241 and the light receiving unit 242 of the sensor position detecting module may be disposed to face each other with the movement path of the position recognition unit 239 interposed therebetween.

Specifically, the light emitting unit 241 emits light in a direction parallel to the rotating shaft A2 of the connecting gear 233. The light emitting unit 241 is coupled to a surface of the outer surface of the housing 236 perpendicular to the rotating shaft A2 of the connecting gear 233. The light receiving unit 242 may be spaced apart from the light emitting unit 241 in the direction of the rotating shaft A2 of the connecting gear 233, and may be disposed to overlap with the light emitting unit 241 in the direction of the rotating shaft A2 of the connecting gear 233.

FIG. 14 is a conceptual diagram illustrating a connection between a sensing module 130 and a driving module 200 according to another embodiment of the present invention. Referring to FIG. 14, the configuration of the sensing module 130 and the driving module 200 according to another embodiment of the present invention is different from the configuration of the sensing module 130 and the driving module 200 of FIG. 1 to FIG. 9.

The rotating shaft A2 of the connecting gear 233 of another embodiment may be disposed not to be parallel to the rotating shaft A1 of the sensing module 130. Specifically, the rotating shaft A2 of the connecting gear 233 may be perpendicular to the cover bottom surface 192*a* of the lower dust container 140 cover, and the he rotating shaft A1 of the sensing module 130 may have a slope in which the upper portion of the rotating shaft is inclined forward in the vertical direction. Accordingly, since the connecting gear 233 is not disposed obliquely with respect to the cover bottom surface 192*a*, there is an advantage that the height of the driving module 200 can be reduced.

Specifically, the connecting gear 233 and the sensor gear 136, which are not parallel to each other, may include a bevel gear. The bevel gears are disposed such that the surface on which teeth are formed are inclined with respect to the rotating shaft of the gear so that two gears having shafts which are not parallel to each other can be connected.

Figure 15:
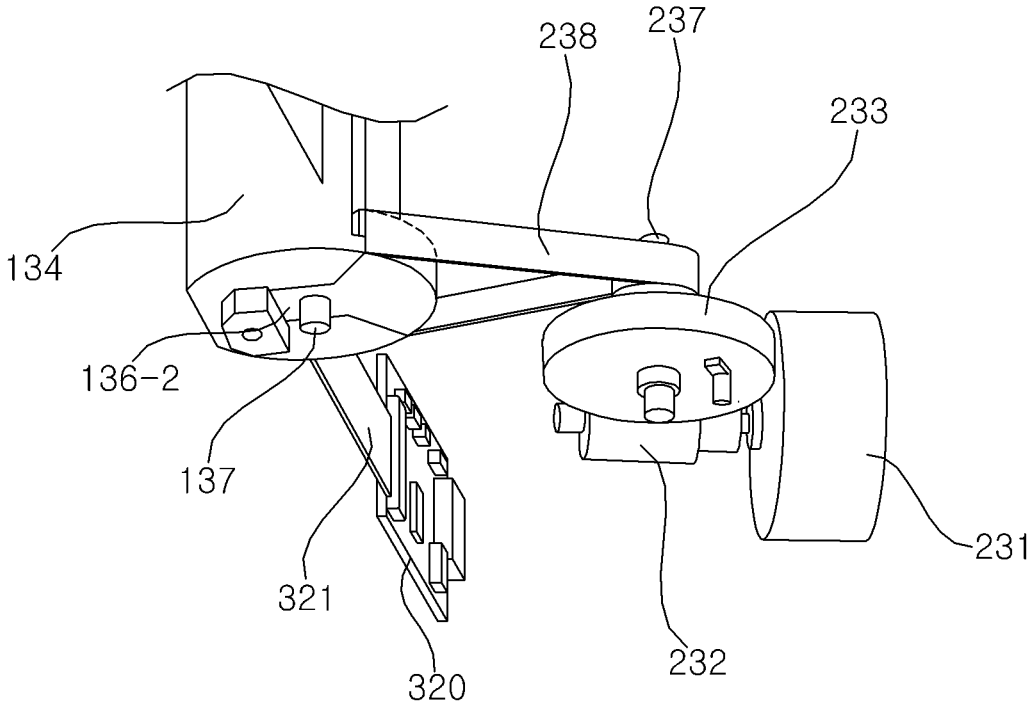
FIG. 15 is a conceptual diagram illustrating a connection between a sensing module and a driving module according to another embodiment of the present invention.

FIG. 15 is a conceptual diagram illustrating a connection between a sensing module 130 and a driving module 200 according to another embodiment of the present invention. Referring to FIG. 15, the driving module of another embodiment may further include a driving belt 238.

The driving belt 238 may transmit the driving force of the driving motor 231 to the sensing module 130. More specifically, an active pulley 237 may be coupled to the rotating shaft A2 of the connecting gear 233 and a driven pulley 136-2 may be coupled the rotating shaft A1 of the sensing module 130. The driving belt 238 is coupled to the active pulley and the driven pulley 136-2.

When the connecting gear 233 is rotated by the driving motor 231, the active pulley 237 having the same shaft as the connecting gear 233 is rotated. When the active pulley 237 is rotated, the driven pulley 136-2 is rotated due to the driving belt 238. When the driven pulley 136-2 is rotated, the sensor case 134 and the sensor unit are rotated.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

Samples of reference numerals include:

110: MAIN BODY
120: CLEANING NOZZLE
130: SENSING MODULE
140: DUST CONTAINER
190: DUST CONTAINER COVER
200: DRIVING MODULE
240: SENSOR POSITION DETECTION MODULE

An aspect of the present disclosure provides a cleaner capable of accurately and quickly recognizing an obstacle on the lateral side of a traveling direction of a cleaner. Another aspect of the present disclosure provides a cleaner capable of accurately and quickly recognizing an obstacle on the lateral side in a change of traveling direction by previously rotating a sensor toward the traveling direction of the cleaner, when the traveling direction of the cleaner is changed.

Another aspect of the present disclosure provides a cleaner in which a sensor unit and a sensor driving module for rotating the sensor unit are installed in a dust container cover and are constrained by the rotation of the dust container cover so that the sensor unit is rotated without interfering with the separation of the dust container. Another aspect of the present disclosure provides a cleaner in which a sensor unit is rotated from side to side in place.

The aspects of the present disclosure are not limited to the above-mentioned problems, and other problems not mentioned can be clearly understood by those skilled in the art from the following description In an aspect, there is provided a cleaner including: a cleaner body; a dust container which is accommodated in the cleaner body; a sensing module which detects information around the cleaner body and is mounted in the cleaner body rotatably about a rotating shaft that intersects a horizontal direction; and a driving module which rotates the sensing module in place relatively to the cleaner body, wherein the sensing module and the driving module are positioned above the dust container. The dust container may be biased forward from the cleaner body.

The sensing module includes: at least one sensor unit which detects the information around the cleaner body; a sensor case which accommodates the sensor unit and has a sensor shaft that is rotatably coupled to the cleaner body; and a sensor gear which is coupled to the sensor case, rotated about the same axis as the sensor shaft, and receives a driving force of the driving module. The driving module includes a driving motor, and the rotating shaft of the driving motor is disposed in parallel with the horizontal direction. The rotating shaft of the sensing module has a preset inclination with respect to a vertical direction.

The driving module includes: a worm gear which is coupled to the rotating shaft of the driving motor; and at least one connecting gear which is coupled to the worm gear and coupled to a rotating module. The rotating shaft of the connecting gear is disposed in parallel with the rotating shaft of the sensing module. The rotating shaft of the connecting gear is disposed in parallel with the vertical direction, and the connecting gear includes a bevel gear.

The driving module includes: a driving motor; at least one connecting gear which transmits a driving force of the driving motor; and a position recognition unit which is disposed in the connecting gear and enables to recognize a rotation angle of the sensing module. The position recognition unit is protruded from a connecting gear in a direction of a rotating shaft of the connecting gear.

The cleaner further includes a sensor position detecting module which detects the position recognition unit. The cleaner further includes a power supply unit which supplies power to the sensing module; and a flexible circuit board which connects the power supply unit and the sensing module. The cleaner body includes: a main body which accommodates the dust container; and a dust container cover which covers the dust container and is rotatably coupled to the main body. At least a part of the sensing module is exposed to a front side of the dust container cover, and the driving module is positioned inside the dust container cover.

The driving module includes a driving motor, and a rotating shaft of the driving motor is disposed in parallel with a bottom surface of the dust container cover. The sensing module and the driving module are constrained by a rotation of the dust container cover and rotated together.

The dust container cover includes: a lower dust container cover; and an upper dust container cover which is coupled to the lower dust container cover and defines a space for accommodating the driving module, and the driving module is fixed to the lower dust container cover. The driving module is positioned eccentrically from a rotating shaft of the sensing module.

In another aspect, there is provided a cleaner including: a cleaner body; a sensing module which detects information around the cleaner body and is mounted in the cleaner body rotatably about a rotating shaft that intersects a horizontal direction; and a driving module which rotates the sensing module in place relatively to the cleaner body, wherein the sensing module includes: at least one sensor unit which detects the information around the cleaner body; a sensor case which accommodates the sensor unit and has a sensor shaft that is rotatably coupled to the cleaner body; and a sensor gear which is coupled to the sensor case, rotated about the same axis as the sensor shaft, and receives a driving force of the driving module.

In another aspect, there is provided a cleaner comprising: a cleaner body; a sensing module which detects information around the cleaner body and is mounted in the cleaner body rotatably about a rotating shaft that intersects a horizontal direction; and a driving module which rotates the sensing module in place relatively to the cleaner body, wherein the driving module includes: a driving motor; and at least one connecting gear which transmits a driving force of the driving motor, wherein the connecting gear further includes a position recognition unit which enables to recognize a rotation angle of the sensing module.

The cleaner according to the present disclosure includes a sensing module for detecting the environment around the cleaner that is rotated at a certain angle with respect to the front so that the sensing module has a wide sensing range in the left and right directions. The sensing module is rotated at a certain angle with respect to the forward direction, so that it is easy to detect obstacles existing on the lateral side of the traveling direction, and when the cleaner body rotates or changes its direction, it is possible to quickly and accurately detect an obstacle existing in the rotation expected path and travel expected path of the cleaner main body.

In addition, the sensor unit is fixed and the rotating sensor driving module is restrained by the rotation of the dust container cover, so that the sensor unit and the sensor driving module are installed in the dust container cover without disturbing the dust container separation. In addition, the sensing module and the sensor driving module are disposed between the dust container and the handle so that when the user holds the handle and separates the dust container, there is no possibility that the sensing module is damaged by a user, and the user can separate the dust container without disturbance of the sensing module, and interference does not occur with respect to the dust collecting apparatus disposed inside the main body.

In addition, the rotating shaft is disposed in a case of the sensing module and the sensing module is rotated in place so that the rotation radius and space of the sensing module are small. In addition, precise position control can be performed using a large gear ratio by using a plurality of gears.

The aspects of the present disclosure are not limited to the aspects mentioned above, and other aspects not mentioned can be clearly understood by those skilled in the art from the description of the claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a body;

a dust container configured to be docked in the body;

a sensor module that includes a sensor to detect information about a region around the body, and that is rotatably coupled to the body at a rotational axis that intersects a horizontal direction; and a motor which provides a driving force to rotate the sensor module relative to the body, wherein the sensor module and the motor are positioned above the dust container, the cleaner further comprising:

at least one connecting gear which transmits the driving force of the motor; and a position sensor target which is provided on the connecting gear and is detected to determine a rotation angle of the sensor module.

2. The cleaner of claim 1, wherein the dust container is biased forward from the body.

3. The cleaner of claim 1, wherein the sensor module further includes:

a case which accommodates the sensor and is rotatably coupled to the body at the rotational axis; and a gear which is coupled to the sensor case to rotate about the rotational axis of the sensor module, and receives the driving force of the motor to rotate the sensor module.

4. The cleaner of claim 1, wherein motor includes a rotating shaft that is provided in parallel with the horizontal direction.

5. The cleaner of claim 4, wherein the rotational axis of the sensor module is provided at a prescribed inclination with respect to a vertical direction.

6. The cleaner of claim 5, wherein the rotational axis of the sensor module is a first rotational axis, and wherein the cleaner further comprises:

a worm gear which is coupled to the rotating shaft of the motor to receive the driving force; and wherein the connecting gear is coupled to the worm gear and is configured to rotate around a second rotational axis.

7. The cleaner of claim 6, wherein the second rotational axis of the connecting gear is provided in parallel with the first rotational axis of the sensor module.

8. The cleaner of claim 6, wherein the second rotational axis of the connecting gear is positioned in parallel with the vertical direction, and wherein the connecting gear includes a bevel gear.

9. The cleaner of claim 1, wherein the position sensor target protrudes from the connecting gear in a direction of a rotational axis of the connecting gear.

10. The cleaner of claim 1, further comprising a position sensor which detects the position sensor target.

11. The cleaner of claim 1, further comprising:

a power supply which supplies power to the sensor module; and a flexible circuit board which connects the power supply and the sensor module.

12. The cleaner of claim 1, wherein the body includes:

a main body configured to selectively receive the dust container; and a cover which covers the dust container when received in the main body and is rotatably coupled to the main body.

13. The cleaner of claim 12, wherein at least a part of the sensor module is exposed to a front side of the dust container cover, and the motor is positioned inside the cover.

14. The cleaner of claim 12, wherein a rotating shaft of the motor is positioned to extend parallel to a bottom surface of the cover.

15. The cleaner of claim 12, wherein the sensor module and the motor are constrained by a rotation of the cover and are configured to be rotated together.

16. The cleaner of claim 12, wherein the cover includes:

a lower cover; and an upper cover which is coupled to the lower cover and defines a space to receive the motor, wherein the motor is coupled to the lower cover.

17. The cleaner of claim 1, wherein the motor is positioned eccentrically from the rotational axis of the sensor module.

18. A cleaner comprising:

a body;

a sensor configured to detect information about a region around the body and is coupled in the body to be rotatable about a rotational axis that intersects a horizontal direction;

a motor the provides a driving force to rotate the sensor relative to the body;

at least one connecting gear which transmits the driving force of the driving motor to the sensor; and a position sensor target provided on the connecting gear and is configured to be detected to recognize a rotation angle of the sensor.

19. The cleaner of claim 18, further comprising:

a case which accommodates the sensor and is rotatably coupled to the body at the rotational axis; and another gear which is coupled to the case to rotate about the rotational axis of the sensor and receives the driving force of the motor from the connecting gear to rotate the sensor.

20. The cleaner of claim 18, wherein the position sensor target protrudes from the connecting gear in a direction of a rotational axis of the connecting gear.

* * * * *